US008687996B2

(12) United States Patent
Mizuno et al.

(10) Patent No.: US 8,687,996 B2
(45) Date of Patent: Apr. 1, 2014

(54) IMAGE FORMING APPARATUS

(75) Inventors: Kyoichi Mizuno, Tama (JP); Tarou Miyamoto, Toyokawa (JP); Kunihiro Kawachi, Kokubunji (JP); Yusuke Kawanago, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 236 days.

(21) Appl. No.: 13/226,851

(22) Filed: Sep. 7, 2011

(65) Prior Publication Data

US 2012/0070179 A1 Mar. 22, 2012

(30) Foreign Application Priority Data

Sep. 21, 2010 (JP) ..... 2010-210601

(51) Int. Cl.
*G03G 21/20* (2006.01)
*G03G 15/20* (2006.01)
*G03G 15/00* (2006.01)

(52) U.S. Cl.
USPC ..... 399/92; 399/323; 399/406

(58) Field of Classification Search
USPC ..... 399/92, 97, 323, 406
See application file for complete search history.

(56) References Cited

U.S. PATENT DOCUMENTS 6,522,847 B2 * 2/2003 Nanjo ..... 399/92
6,823,151 B2 * 11/2004 Carlson et al. ..... 399/92
7,149,453 B2 * 12/2006 Fujita ..... 399/92

FOREIGN PATENT DOCUMENTS

JP 7-157120 A 6/1995
JP 2006-264918 A 10/2006

* cited by examiner

*Primary Examiner* — David Gray
*Assistant Examiner* — Gregory H Curran
(74) *Attorney, Agent, or Firm* — Cantor Colburn LLP

(57) ABSTRACT

An image forming apparatus, including an upper section including an image forming section to form an image on a recording sheet, a lower section arranged below the upper section including a sheet supplying tray to stack a plurality of recording sheets, a partitioning body to separate the upper section and the lower section in a vertical direction, wherein the lower section includes a dehumidification device to heat the inside of the lower section and to dehumidify the recording sheets stacked on the sheet supplying tray, the partitioning body includes a first shielding member to shield a bottom portion of the upper section, a second shielding member separated from the first shielding member to shield a top portion of the lower section, a clearance formed between the first shielding member and the second shielding member, and an air blowing section to blow air into the clearance.

4 Claims, 5 Drawing Sheets

IMAGE FORMING APPARATUS

CROSS REFERENCE TO RELATED APPLICATION

This application is based on Japanese Patent Application No. 2010-210601 filed on Sep. 21, 2010, with the Japanese Patent Office, the entire content of which is hereby incorporated by reference.

TECHNICAL FIELD

The present invention relates to image forming apparatuses, such as copy machines, printers, and facsimile devices, and in particular, to image forming apparatuses incorporating a sheet supplying section.

BACKGROUND ART

Recording sheets, to be used in the image forming apparatuses, tend to absorb environmental moisture, due to the environment and the storage conditions. In case that a recording sheet is picked up to be conveyed from a bundle of sheets, accommodated in a sheet supplying section of the image forming apparatus, and is used for the image formation, if said bundle of recording sheets has absorbed moisture under a high humidity environment, due to moisture existing between the recording sheets, the recording sheets tend to adhere to each other. When said recording sheet is conveyed through the image forming apparatus, said recording sheet adheres to the next recording sheet, so that plural recording sheets are simultaneously conveyed, which conveyance is so called "double sheet conveyance", further, a sheet conveying timing delay in the image forming apparatus tends to occur, which become major problems.

In recent years, high glossy images are requested for printing catalogues or posters. Coated printing sheets are used for this purpose. The coated printing sheet, having a resin coat on the surface, has higher flatness than a normal sheet. Accordingly, the coated printing sheets have higher adherence to each other than normal sheets. When said coated printing sheet is to be supplied from the sheet supplying section of the image forming apparatus, the above described double sheet conveyance and the sheet conveying timing delay tend to occur. In particular, under high humidity conditions, since the recording sheets, including the coated printing sheets, absorb moisture, and strongly adhere to each other, whereby the above described adverse problems tend to occur.

To overcome these problems, concerning image forming apparatuses, described in Japanese Unexamined Patent Application Publications 7-157120 and 2006-264918 (hereinafter referred to as JPA 120 and JPA 918), the sheet supplying section is formed to be a sealed structure, and a dehumidification heater is arranged in the sheet supplying section, so that widely varying types of recording sheets are dehumidified.

In the image forming apparatus described in above JPA 120, the inside of the apparatus is sealed by a cover member and a lower frame, and a partitioning plate is arranged between an upper mechanical section of the apparatus and the sheet supplying section, accommodating plural sheet supplying trays, so that ambient air cannot enter the inside of the sheet supplying device. Further, a heat generating body, installed in the lower frame, allows air to make convection in the inside of the sheet supplying device, so that the recording sheets, accommodated in each tray, are dehumidified.

In the image forming apparatus described in above JPA 918, a conveying path, for conveying the recording sheet to the image farming section, is closed or opened by a shutter, whereby a sheet supplying section, accommodating a dehumidification heater, is tightly sealed, and the recording sheets, stacked on the plural sheet supplying trays, are effectively dehumidified.

However, in order to make smooth sheets, such as coated printing sheets, to decrease adherence to each other, and to stably supply the sheets, the inside of the sheet supplying section must be heated to about 50° C. In the image forming apparatuses, described in JPA 120 and JPA 918, the temperature of the partitioning plate, above the sheet supplying section, reaches more than 50° C. The image forming section receives the heat, coming from the partitioning plate, and the temperature of the image forming section increases, so that adverse problems occur, relating to a photosensitive body and image forming processes around the photosensitive body. In particular, if low temperature melting toner is used in the image funning section, said problems occur notably.

In order to overcome these problems relating to the heat, there are ideas to increase the heat insulating properties of the partitioning plate, or to cool the image forming section. To realize those ideas, the apparatus becomes complicated.

SUMMARY OF THE INVENTION

An object of the present invention is to offer an image forming apparatus, in which the heat, coming from the heated sheet supplying section and entering the image forming section, is effectively controlled by a simple structure, and by which image formation is stably conducted.

An image forming apparatus of the present invention includes an upper section including an image forming section to form an image on a recording sheet, a lower section arranged below the upper section including a sheet supplying tray to stack a plurality of recording sheets, a partitioning body to separate the upper section and the lower section in a vertical direction, wherein the lower section includes a dehumidification device to heat the inside of the lower section and to dehumidify the recording sheets stacked on the sheet supplying tray, the partitioning body includes a first shielding member to shield a bottom portion of the upper section, a second shielding member separated from the first shielding member to shield a top portion of the lower section, a clearance formed between the first shielding member and the second shielding member, and an air blowing section to blow air into the clearance.

BRIEF DESCRIPTIONS OF THE DRAWINGS

Embodiments will now be detailed, by way of example only, with reference to the accompanying drawings which are meant to be exemplary, not limiting, and wherein like embodiments are numbered alike in the several figures, in which.

DETAILED DESCRIPTIONS OF THE PREFERRED EMBODIMENTS

Figure 1:
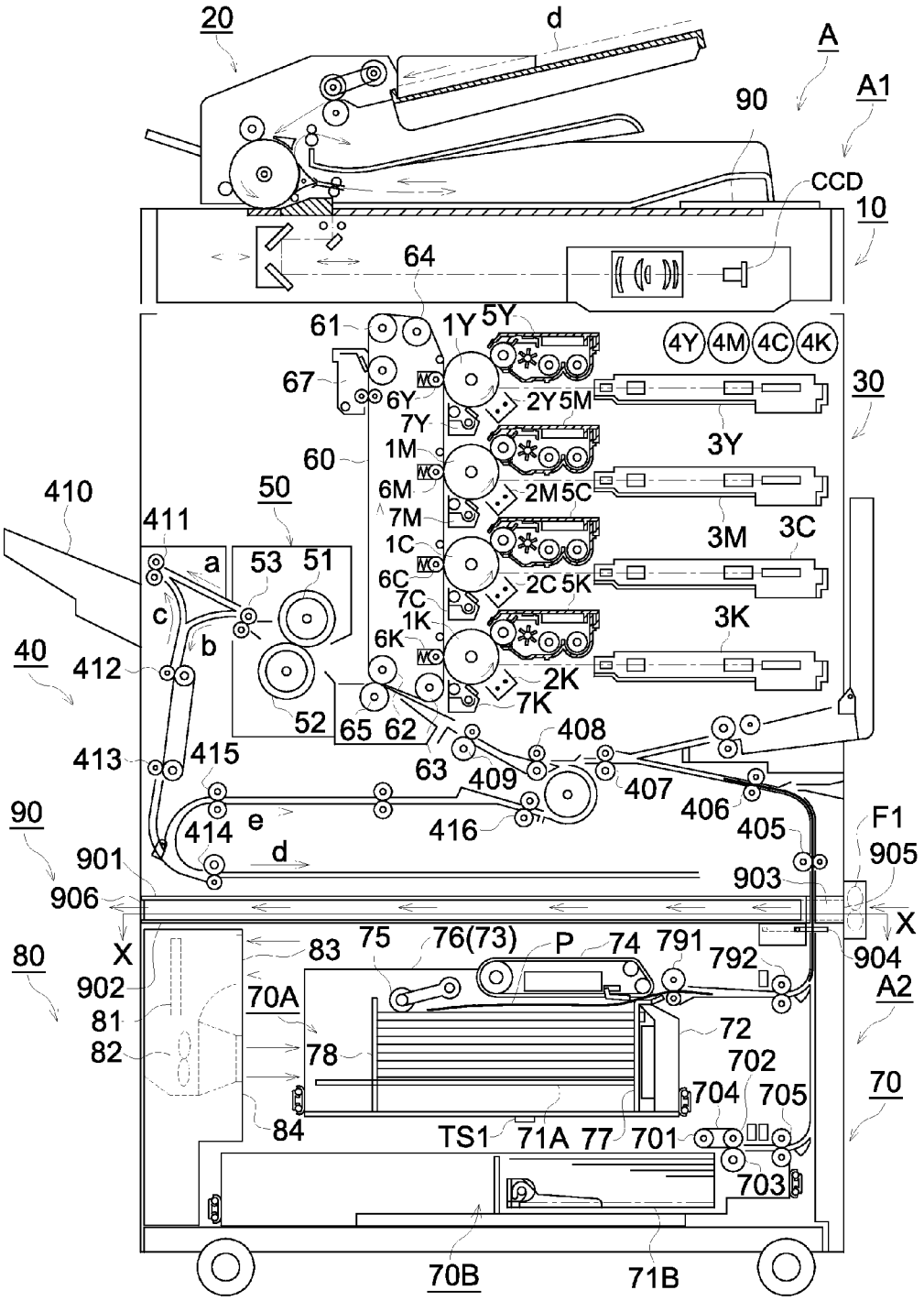
FIG. 1 is a cross-sectional drawing to show image forming apparatus A relating to the present invention.

The embodiments to conduct the present invention will now be detailed, while referring to the drawings. The structures of the present invention are not limited to these embodiments. The detailed structures can be appropriately changed within the scope of this invention, as long as it does not deviate from the content of the present invention.

The image forming apparatuses used in the present invention includes various apparatuses which are able to form images on the recording members. Listed are copy machines, printers, facsimile machines, multi-function peripherals, or the like. Image forming apparatus A, being a tandem-type full color copy machine, is detailed in the following explanations.

FIG. 1 is a cross-sectional drawing to show an example of image forming apparatus A relating to the present invention.

Image forming apparatus A is structured of upper section A1, including image forming section 30, and lower section A2, including plural sheet supplying trays to accommodate the recording sheets.

A recording member, to be used in image forming apparatus A, is formed of paper, OHP sheet, or the like. Hereinafter, the recording member is referred to as sheet P.

[Upper Section A1 of Image Forming Apparatus A]

Upper Section A1 of Image Forming Apparatus A includes original document reading device 10, original document feeding device 20, image forming section 30, sheet conveying section 40, and image fixing device 50.

Original document reading device 10 and original document feeding device 20 are located on the superior part of upper section A1. Images, printed on original document "d" fed by original document feeding device 20, are focused to be read on line image sensor CCD, by the optical system of original document reading device 10.

The images, read on line image sensor CCD, are photoelectrically converted to be analog signals. An image processing section, not illustrated, conducts an analog process, an A/D conversion, a shading correction, and an image compressing process, with respect to said analog signals, whereby digital image data are generated for yellow, magenta, cyan, and black color.

Image forming section 30 has photosensitive drum bodies 1Y for yellow, 1M for magenta, 1C for cyan and 1K for black color. Electric charging devices 2Y, 2M, 2C and 2K, exposure devices 3Y, 3M, 3C and 3K, and developing devices 5Y, 5M, 5C and 5K are arranged around said photosensitive drum bodies.

Electric charging devices 2Y, 2M, 2C and 2K evenly conduct electrical charging onto photosensitive bodies 1Y, 1M, 1C and 1K, respectively. Exposure devices 2Y, 2M, 2C and 2K form latent images on photosensitive bodies 1Y, 1M, 1C and 1K, respectively, based on the digital image data of each color.

Developing devices 5Y, 5M, 5C and 5K receive toner from toner supplying devices 4Y, 4M, 4C, and 4K, respectively, and the latent images of each color, formed on photosensitive bodies 1Y, 1M, 1C and 1K, are developed, so that toner images of each color are formed on photosensitive bodies 1Y, 1M, 1C and 1K, respectively. Developing devices 5Y, 5M, 5C and 5K are arranged vertically as shown in FIG. 1.

Image forming section 30 includes transfer device 6 which transfers each of color toner images formed on photosensitive bodied 1Y, 1M, 1C, and 1K onto recording sheet P, and cleaning devices 7Y, 7M, 7C and 7K which clean photo sensitive bodies 1Y, 1M, 1C and 1K, respectively. Transfer device 6 includes intermediate transfer body 60, primary transfer rollers 6Y, 6M, 6C and 6K, secondary transfer roller 65, and transfer device cleaning section 67. Intermediate transfer body 60, which is arranged at the left side of photosensitive bodies 1Y, 1M, 1C and 1K, is a semi-conductive endless belt which is entrained about rollers 61, 62, 63 and 64. Intermediate transfer body 60 is rotated by roller 61 in the direction shown by an arrow, in which roller 61 is connected to a driving device, not illustrated.

Primary transfer rollers 6Y, 6M, 6C and 6K press intermediate transfer body 60 against photosensitive bodies 1Y, 1M, 1C and 1K, respectively, after that, each of color images formed on photosensitive bodies 1Y, 1M, 1C and 1K is sequentially transferred onto intermediate transfer body 60 to be overlapped, whereby a full color toner image can be formed on intermediate transfer body 60.

Secondary transfer roller 65 transfers the full color toner image formed on intermediate transfer body 60 onto recording sheet P which has been conveyed through sheet conveying section 40, whereby the full color toner image is formed on recording sheet P, as the overlapped color images.

Transfer device cleaning section 67 removes the toner remaining on intermediate transfer body 60. Because some toner particles are not transferred onto recording sheet P, and remain on intermediate transfer body 60.

Sheet conveying section 40, arranged at the bottom of upper section A1, includes plural rollers 405, 406, 407 and 408, paired registration rollers 409, paired sheet ejection rollers 411, and three sheet conveying paths, which will be detailed later. Sheet conveying section 40 receives sheet P from sheet supplying section 70 of lower section A2. Subsequently, it conveys sheet P to secondary transfer roller 65. After that, it conveys sheet P to fixing device 50.

Fixing device 50 includes heating roller 51 and pressure applying roller 52. Fixing device 50 fixes sheet P, on which color image has been transferred. After that, fixing device 50 conveys said sheet P to a sheet ejection system of sheet conveying section 40, through paired fixed sheet ejection rollers 53.

The sheet ejection system of sheet conveying section 40 has three sheet conveying paths. Sheet P is conveyed to a selected sheet conveying path, based on a printing job.

A first conveying path coveys sheet P in arrowed direction "a" in FIG. 1. That is, the first conveying path conveys sheet P, ejected through paired fixed sheet ejection rollers 53, to paired ejection rollers 411, and ejects onto ejection tray 410.

A second conveying path includes conveying paths shown by arrows "b and "c". That is, the second conveying path reverses sheet P, ejected through paired fixed sheet ejection rollers 53, by rollers 412 and 413, and ejects onto ejection tray 410.

A third conveying path is structured of conveying paths shown by arrows "b", "d" and "e". That is, after the third conveying path conveys fixed sheet P to conveying path b, it conveys said sheet P to conveying path d to reverse said sheet P by paired rollers 414. After that, the third conveying path conveys said sheet P to conveying path e, whereby it conveys said sheet P to image forming section 30 to form an image on the reverse surface of said recording sheet P.

[Lower Section A2 of Image Forming Apparatus A]

Lower section A2 includes sheet supplying section 70 and dehumidifying section 80. Sheet supplying section 70 includes first sheet supplying tray 71A and second sheet supplying tray 71B. Dehumidifying section 80 is configured to heat the air in lower section A2 and dehumidify sheets P, accommodated in first sheet supplying tray 71A and second sheet supplying tray 71B.

Sheet supplying section 70 is able to accommodate a large number of recording sheets P. Further, sheet supplying section 70 includes first sheet supplying unit 70A, which is able to supply recording sheets P one by one, wherein said recording sheets P represent widely varying types of recording sheets, including smooth sheets. Sheet supplying section 70 further includes second sheet supplying unit 70B, which is able to supply large-size normal recording sheets P.

First sheet supplying unit 70A is structured mainly of first sheet supplying tray 71A, first sheet flotation section 72, second sheet flotation section 73, suction conveying section 74, and sheet holding section 75.

First sheet supplying tray 71A is driven vertically by an elevating mechanism, which is not illustrated, and can accommodate approximately 2,000 recording sheets P.

First sheet flotation section 72 blows air from downstream of the sheet conveying direction, against the leading edges of sheets P, accommodated on first sheet supplying tray 71A, whereby uppermost recording sheet P is floated.

Second sheet flotation section 73 blows air in the width direction, being perpendicular to the sheet conveying direction, against both edges of sheets P, accommodated on first sheet supplying tray 71A, whereby uppermost recording sheet P is floated.

Suction conveying section 74 is configured to suction air and accommodate said air in its interior portion. That is, suction conveying section 74 vacuums uppermost sheet P, floated by first sheet floatation section 72 and second sheet floatation section 73, and conveys said vacuumed sheet P in a sheet conveying direction.

Sheet holding section 75 is positioned upstream of suction conveying section 74 in the sheet conveying direction. Sheet holding section 75 presses against the top surface of stacked sheets P, whereby uppermost sheet P is vertically controlled from the top, so that wide areas of said uppermost sheet P float. Due to this, air separation is conducted between stacked sheets P.

The position of sheet P, stacked on first sheet supplying tray 71A, can be controlled by four control sections, described below. Paired width controlling sections 76 are movably arranged in the sheet width direction to control both sides of sheet P. Further, paired width controlling sections 76 blow air to float sheet P from an upper opening, wherein said paired width controlling sections 76 double with second sheet floatation section 73.

Leading edge controlling section 77 is arranged downstream of first sheet supplying tray 71A in the sheet conveying direction. Leading edge controlling section 77 controls the leading edge of sheet P. Trailing edge controlling section 78 is arranged to be movable in the sheet conveying direction, whereby said trailing edge controlling section 78 pushes to control the trailing edge of sheet P.

Suction sensor PS1 (which is not illustrated) arranged on suction conveying section 74 detects vacuumed uppermost sheet P. Suction conveying section 74 conveys said vacuumed sheet P to first conveying roller 791, arranged downstream in the sheet conveying direction. First conveying roller 791 is driven synchronizing with suction conveying section 74, to convey sheet P to second sheet conveying roller 792. First conveying roller 791 coordinates with second sheet supplying roller 792 to convey sheet P at predetermined timing from first sheet supplying unit 70A to sheet conveying section 40 of upper section A1.

Further, the height of uppermost sheet P, stacked on first sheet supplying tray 71A, is controlled at an appropriate level, by an upper limit detection sensor and an elevating mechanism.

Second sheet supplying unit 70B includes second sheet supplying tray 71B to accommodate recording sheets P, pick-up roller 701 to pick up uppermost recording sheet P accommodated in second sheet supplying tray 71B, sheet supplying roller 702 to convey recording sheet P, picked up by pick-up roller 701, downstream in the sheet conveying direction, and sheet separating roller 703 to prevent double sheet-conveyance of recording sheets P, at a pressing section where said sheet separating roller 703 presses against sheet supplying roller 702.

Sheet supplying roller 702, which is driven by a driving mechanism, being not illustrated, conveys uppermost recording sheet P in the downstream direction, while working with pick-up roller 701. Pick-up roller 701 is rotated counterclockwise by transfer belt 704 driven by sheet supplying roller 702.

Further, sheet separation roller 703 applies urging force in the upstream direction by an urging section, not illustrated, to recording sheet P, picked up by pick-up roller 701, so that the double-sheet conveyance is prevented.

Sheet conveying roller 705 conveys recording sheet P, having been supplied by sheet supplying roller 702, from second sheet supplying unit 70B to sheet conveying section 40 of upper section A1 of image forming apparatus A, at predetermined timing.

Dehumidifying section 80 is arranged at the left of first sheet supplying tray 71A and second sheet supplying tray 71B in FIG. 1, and includes heater 81 and fan 82. The air in lower section A2 of image forming apparatus A is vacuumed through inlet 83, arranged at the upper portion of dehumidifying section 80, and heated air is blown out from outlet 84, arranged at the lower portion, so that heated air is circulated within lower section A2 of image forming apparatus A, in which first sheet supplying tray 71A and second sheet supplying tray 71B are arranged.

Further, since lower section A2 is formed to be an enclosed structure, the air in lower section A2 does not exchange with ambient air. By dehumidifying section 80, the inside of lower section A2 is heated so that the temperature of every part is controlled to be the same. Accordingly, recording sheets P in first sheet supplying tray 71A and sheets P in second sheet supplying tray are dehumidified, whereby the stacked recording sheets are not adhered by humidity to each other, and the sheet supplying performance remains stable.

Thermal sensor TS1 is mounted on first sheet supplying unit 70A, and a control section, which is not illustrated, controls heater 81 to keep the temperature of the inside of lower section A2 within a predetermined range. Instead of thermal sensor TS1, it is possible to use a humidity sensor for the present embodiment, and the control section controls heater 81 to keep the humidity of the inside of lower section A2 to be less than a predetermined level.

Recording sheets P, accommodated in sheet supplying section 70 of lower section A2, are exposed to air which exhibits a higher temperature than the ambient temperature by dehumidifying section 80, regardless of image forming time and image non-forming time.

[Partitioning Body]

On a building frame of image forming apparatus A, partitioning body 90 is mounted to separate upper body A1 and lower body A2 in the vertical direction. Partitioning body 90 includes first shielding member 901 to shield the bottom of upper body A1, and second shielding member 902 to shield the upper portion of lower body A2. Partitioning body 90 has a clearance, which is formed between first shielding member 901 and second shielding member 902. Air can move in the horizontal direction through said space. Further, openings 905 and 906 are provided on both ends of partitioning body 90. The inner air can be exchanged with the outer air through inlet opening 905 and outlet opening 906.

First shielding member 901, formed of iron plates, is a box, having an opening on its lower part. First shielding member 901 is a part of the building frame of image forming apparatus A.

Second shielding member 902, also formed of iron plates, is a box, having an opening on its upper part. Second shielding member 902 is a part of the building frame of image forming apparatus A.

In the present embodiment, the opening of first shielding member 901 is welded to the opening of second shielding member 902. That is, the openings of first and second shielding members 901 and 902, being the parts of the building frame of image forming apparatus A, are welded to each other, whereby the integrity of the building frame of image forming apparatus A is effectively increased.

As shown in FIG. 1, partitioning body 90 has cutout portion 903, in which a sheet conveying path is provided to convey recording sheet P from sheet supplying section 70 of lower body A2 to image forming section 30 of upper body A1.

Adjacent to cutout portion 903, shutter 904 is arranged, which is configured to close cutout portion 903 while recording sheet P is not conveyed, and to control the heated air, coming from lower body A2, not to enter upper body A1. Dashed lines, showing cutout portion 903, show a condition in which the sheet conveying path is opened, while solid lines show a condition in which the sheet conveying path is closed.

Air blow fan F1, serving as an air blowing section, is arranged at the right of image forming apparatus A in FIG. 1. Ambient air G is blown into partitioning body 90, that is, ambient air G is blown from right to left into the space, which is formed between first shielding member 901 and second shielding member 902. Due to ambient air G being blown into the space, first shielding member 901 is prevented from being heated by the heat which is secondarily-emitted from highly heated second shielding member 902.

While ambient air G, introduced through inlet opening 905, passes through the inside of partitioning body 90, said ambient air G is heated, and heated ambient air G is ejected through outlet opening 906. The left side of first shielding member 901 is heated higher than the right side of first shielding member 901 in FIG. 1, which have little influence on image forming section 30.

As detailed above, concerning image forming apparatus A, including partitioning body 90 relating to the present invention, in order to dehumidify recording sheets P, accommodated in sheet supplying trays 71A and 71B, lower body A2 is configured to be heated for a long period of time to be higher than the ambient environment, so that widely varying types of recording sheets P can be stably supplied to the image forming section, and the heat influence onto the image forming section is overcome, whereby image formation can be stably conducted for a long period.

Figure 2:
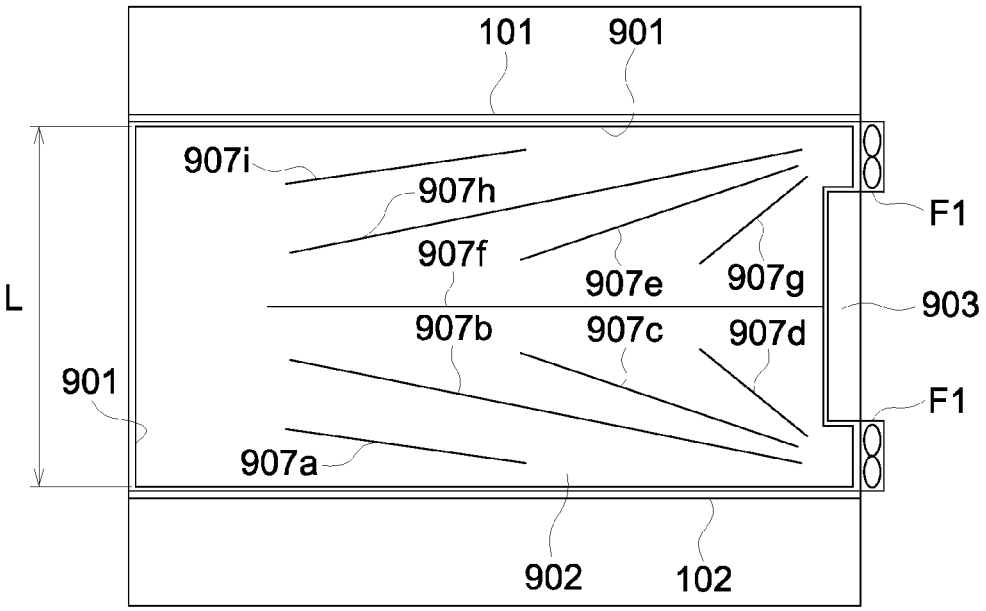
FIG. 2 is a cross sectional drawing taken along line X-X of FIG. 1 to show a structure of partitioning body 90, relating to the present invention.

FIG. 2 is a cross-sectional drawing taken along line X-X of FIG. 1, to show the structure of partitioning body 90, relating to the present invention.

Rear building frame 101 is a plate to support the rear of image forming apparatus A. Front building frame 102 is a plate to support the front of image forming apparatus A. First shielding member 901 is mounted on both rear building frame 101 and front building frame 102, perpendicular to the surfaces of rear building frame 101 and front building frame 102, so that the mechanical structure of the center of image forming apparatus A is enhanced in the vertical direction.

Air guide ribs 907 (907*a*-907*i*) are mounted to expand horizontally on first shielding member 901, so that the direction of air, flowing through the clearance of partitioning body 90, is effectively controlled. The air flows to all areas of partitioning body 90 by these air guide ribs 907, so that while the total areas of first shielding member 901 are controlled to be the same temperature, first shielding member 901 can be cooled. Further, air guide ribs 907 help first shielding member 901 to be mechanically enhanced, whereby thin plate members can be used for first shielding member 901 and second shielding member 902.

Figure 5:
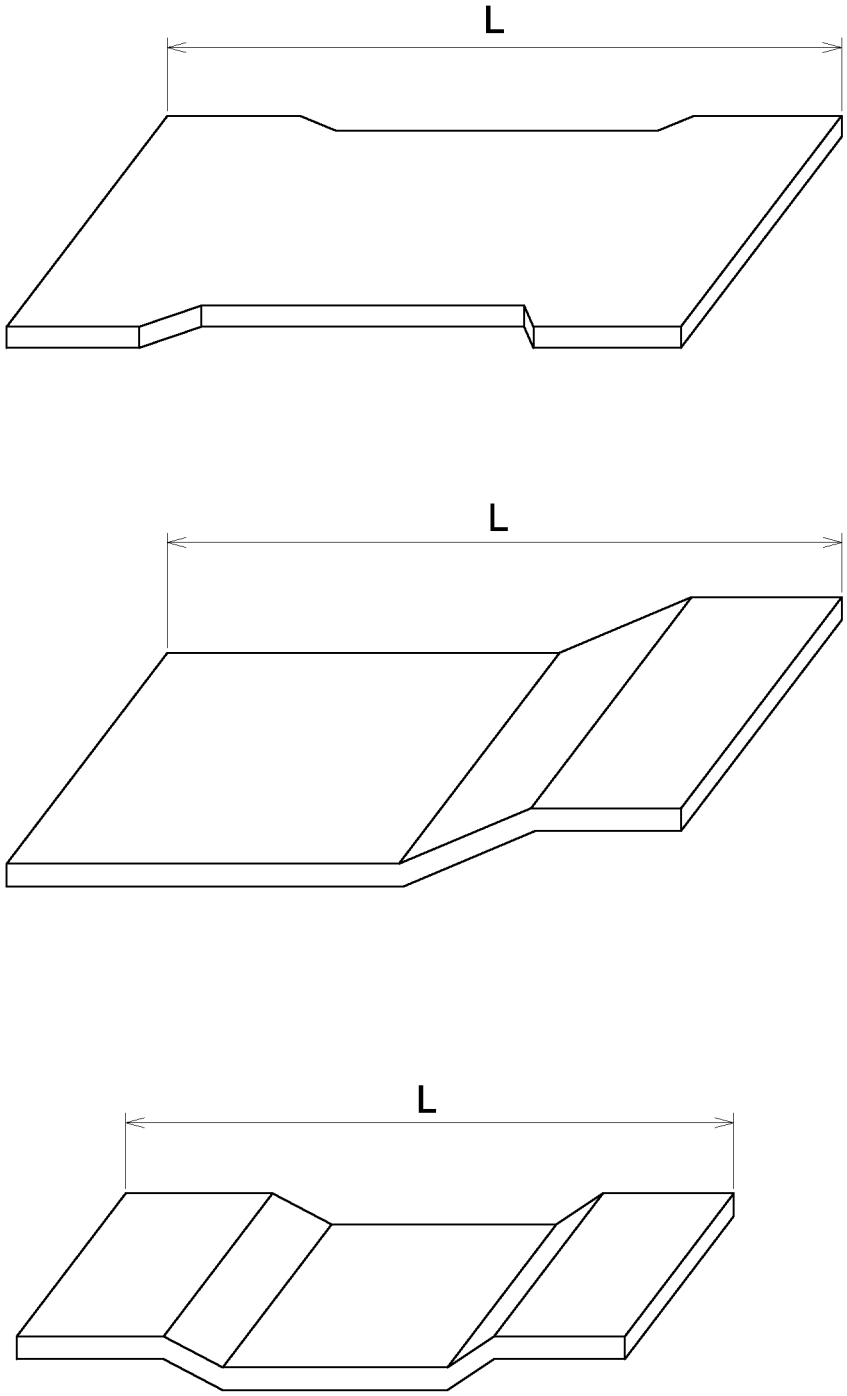
FIG. 5 is a schematic drawing to show an example of partitioning body 90, relating to the present invention.

FIG. 5 is a schematic drawing to show examples of first shielding member 901 and second shielding member 902 of partitioning body 90, relating to the present invention. "L" represents the length of first shielding member 901 and second shielding member 902, in the direction perpendicular to the air flow direction, as shown in FIG. 2. Further, "L" represents the length of first shielding member 901 and second shielding member 902 in the air flow direction.

The metallic plates are welded to first shielding member 901 shown in FIG. 2, to enhance the mechanical structure, and to increase the cooling function.

As detailed above, partitioning body 90 of the present invention is structured to be a simple body. The air is effectively kept at a high temperature, in lower body A2 including sheet supplying trays 71A and 71B. Heat is prevented from transferring from lower body A2 to upper body A1, so that image forming section 30 in upper body A1 is controlled to function at a lower temperature.

[Another Embodiment]

Figure 3:
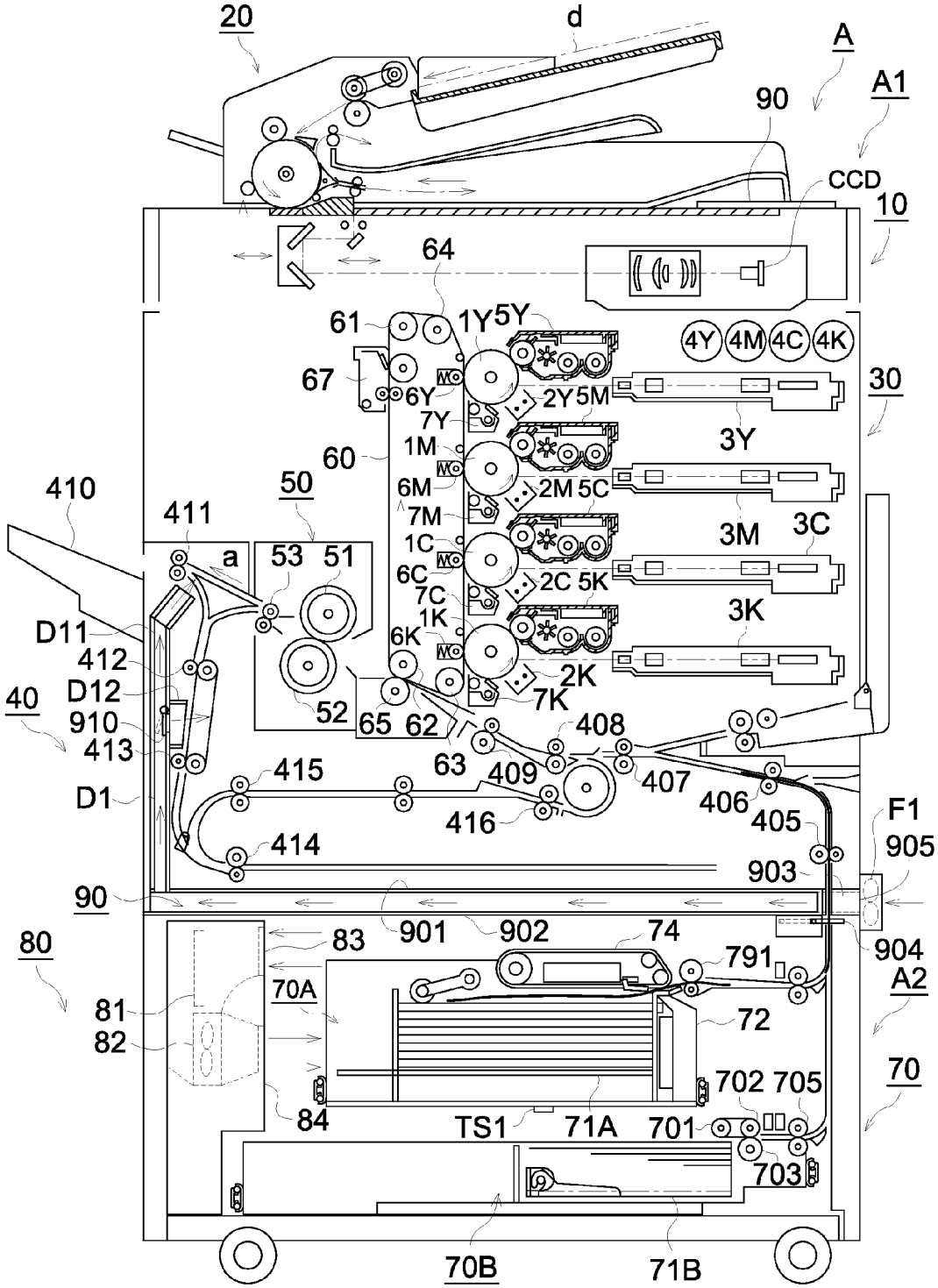
FIG. 3 is a drawing to show another embodiment (1) of image forming apparatus A, relating to the present invention.

In FIG. 3, the air is heated while air is blown through partitioning body 90 by air fans F1. Said heated air is further guided upward to reach near fixing device 50 in upper body A1 by first air duct D1. Subsequently, said heated air is applied to the total surface of recording sheet P, being conveyed on a sheet conveying path, which is mounted downstream of fixing device 50. That is, since recording sheet P has been highly heated by fixing device 50, said heated air, coming through first air duct D1, can slowly cool heated recording sheet P, whereby recording sheet P is prevented from curling after the fixing process, which is another embodiment (1) of image forming apparatus A.

First air duct D1 is branched at a switching point into first branched duct D11 and second branched duct D12. Switching member 910 is mounted at the switching point to send the heated air to first branched duct D11 or second branched duct D12. Switching member 910, shown by solid lines, guides the heated air upstream of sheet ejection roller 411 through first branched duct D11. Switching member 910, shown by dashed lines, guides heated air toward a path between conveying rollers 412 and 413 through second branched duct D12.

For single surface printing, switching member 910 is switched to a condition shown by the solid lines, the heated air is applied to recording sheet P being ejected in the direction shown by arrow "a" in FIG. 3, whereby sheet P, fixed by fixing device 50, can be slowly cooled.

For double-surface printing, or for reversed-sheet ejecting, switching member 910 is switched to a condition shown by dashed lines, the heated air is applied to recording sheet P, being conveyed in the path between conveying rollers 412 and 413, whereby sheet P, fixed by fixing device 50, can be slowly cooled.

Figure 4:
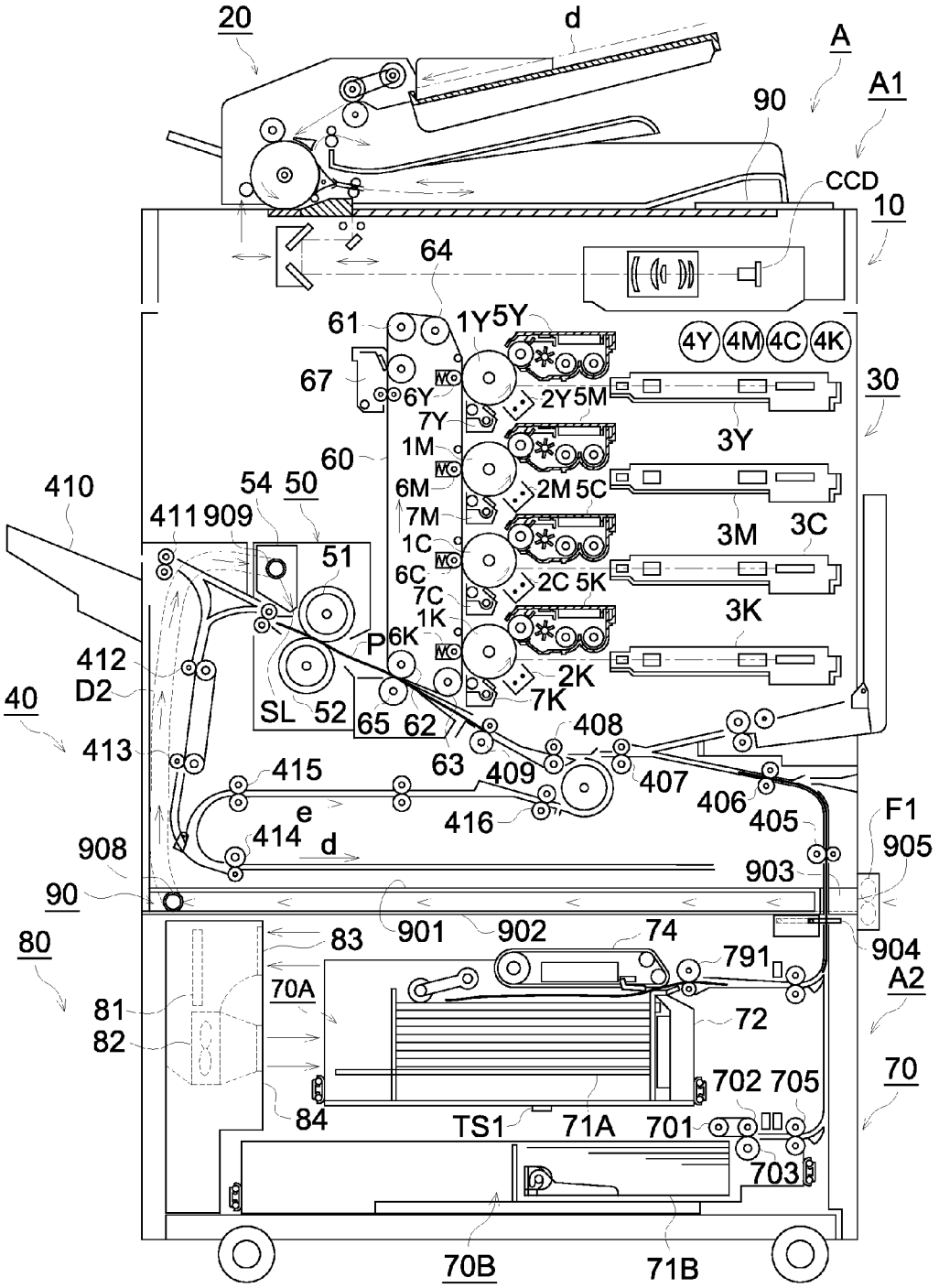
FIG. 4 is a drawing to show still another embodiment (2) of image forming apparatus A, relating to the present invention.

Still another embodiment (2) of image forming apparatus A is shown in FIG. 4. The ambient air is blown by air fans F1 into the inside of partitioning body 90, and is heated while passing through partitioning body 90. The heated air is guided to an area near fixing device 50 through second air flow duct D2. The heated air is applied onto sheet P which is ejected from the nip between heating roller 51 and pressuring roller 52, whereby the heated air helps recording sheet P to smoothly separate from heating roller 51.

Second air flow duct D2, being a pipe, is connected to air outlet 908, mounted at the left-rear portion of partitioning body 90 in FIG. 4. The other end of second air flow duct D2 is connected to air inlet 909, mounted at the upper left of fixing device 50 in FIG. 5. Chamber 54, including air inlet 909, is mounted at the upper left of fixing device 50. Air outlet SL is mounted to reach across the width of recording sheet P in chamber 54.

The heated air heated in partitioning body 90 is ejected from air outlet SL of chamber 54, through second air flow duct D2. Said heated air is applied onto heating roller 51 which is mounted downstream of the nip, and enters between heating roller 51 and recording sheet P ejected from the nip of fixing device 50, whereby recording sheet P is effectively prevented from winding around heating roller 51.

EFFECT OF THE EMBODIMENTS

The present embodiment includes the upper section including the image forming section, the lower section including the sheet supplying tray, the dehumidification device to heat the inside of the lower section and to dehumidify the recording sheets stacked on the sheet supplying tray, the partition to separate the first shielding member and the second shielding member, in the vertical direction, and the air blowing section to blow external air into the inside of the partitioning body, whereby the heat, entering the image forming section from the top portion of the heated sheet supplying section, is shielded by the simple structure, so that the image forming apparatus, which can stably form images, can be offered.

What is claimed is:

1. An image forming apparatus, comprising:

an upper section including an image forming section to form an image on a recording sheet;

a lower section, arranged below the upper section, including a sheet supplying tray to stack a plurality of recording sheets;

a partitioning body to separate the upper section and the lower section in a vertical direction, wherein the lower section includes a dehumidification device to heat the inside of the lower section and to dehumidify the recording sheets stacked on the sheet supplying tray, and wherein the partitioning body includes:

a first shielding member to shield a bottom portion of the upper section;

a second shielding member, separated from the first shielding member, to shield a top portion of the lower section;

a clearance formed between the first shielding member and the second shielding member;

an air blowing section to blow air into the clearance, and a guide rib which controls a flowing direction of air flowing through the clearance formed between the first shielding member and the second shielding member so that the first shielding member or the second shielding member is maintained at the same temperature.

2. The image forming apparatus of claim 1, wherein the partitioning body comprises a building frame of the image forming apparatus.

3. An image forming apparatus comprising:

an upper section including an image forming section to form an image on a recording sheet;

a lower section, arranged below the upper section, including a sheet supplying tray to stack a plurality of recording sheets;

a partitioning body to separate the upper section and the lower section in a vertical direction, wherein the lower section further includes a dehumidification device to heat the inside of the lower section and to dehumidify the recording sheets stacked on the sheet supplying tray, and wherein the partitioning body includes:

a first shielding member to shield a bottom portion of the upper section;

a second shielding member, separated from the first shielding member, to shield a top portion of the lower section;

a clearance formed between the first shielding member and the second shielding member; and an air blowing section to blow air into the clearance, wherein the upper section further includes a first duct which guides the air blown by the air blowing section to the upper section, wherein the air guided by the first duct is applied to the recording sheet passing through a sheet conveying path arranged downstream of a fixing device which is mounted on the upper section.

4. An image forming apparatus comprising:

an upper section including an image forming section to form an image on a recording sheet;

a lower section, arranged below the upper section, including a sheet supplying tray to stack a plurality of recording sheets;

a partitioning body to separate the upper section and the lower section in a vertical direction, wherein the lower section includes a dehumidification device to heat the inside of the lower section and to dehumidify the recording sheets stacked on the sheet supplying tray, and wherein the partitioning body includes:

a first shielding member to shield a bottom portion of the upper section;

a second shielding member, separated from the first shielding member, to shield a top portion of the lower section;

a clearance formed between the first shielding member and the second shielding member, and an air blowing section to blow air into the clearance, wherein the upper section further includes a second duct which guides the air blown by the air blowing section to the fixing device mounted on the upper section, wherein the air guided by the second duct is applied to the recording sheet passing through the fixing device, to help a sheet to separate from the fixing device.

* * * * *